US010691058B2

(12) United States Patent
Sasaki et al.

(10) Patent No.: US 10,691,058 B2
(45) Date of Patent: Jun. 23, 2020

(54) IMAGE FORMING APPARATUS, LUBRICANT APPLICATION METHOD, AND COMPUTER PROGRAM

(71) Applicant: KONICA MINOLTA, INC., Chiyoda-ku, Tokyo (JP)

(72) Inventors: Kunitomo Sasaki, Nukata-gun (JP); Masayasu Haga, Toyokawa (JP); Sayaka Morita, Gamagori (JP); Tsugihito Yoshiyama, Toyohashi (JP)

(73) Assignee: KONICA MINOLTA INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/599,252

(22) Filed: Oct. 11, 2019

(65) Prior Publication Data

US 2020/0133189 A1 Apr. 30, 2020

(30) Foreign Application Priority Data

Oct. 24, 2018 (JP) ..... 2018-199732

(51) Int. Cl.
*G03G 21/00* (2006.01)

(52) U.S. Cl.
CPC ..... *G03G 21/0094* (2013.01)

(58) Field of Classification Search
CPC ..... G03G 21/0094
USPC ..... 399/346
See application file for complete search history.

(56) References Cited

U.S. PATENT DOCUMENTS

| | | | | |
|---|---|---|---|---|
| 8,380,115 | B2 * | 2/2013 | Shintani et al. ... | G03G 21/0011 399/346 |
| 8,712,261 | B2 * | 4/2014 | Kudo et al. ..... | G03G 21/0094 399/346 |
| 9,360,826 | B2 * | 6/2016 | Saito et al. ..... | G03G 21/0094 |
| 9,798,288 | B2 * | 10/2017 | Maehata et al. ... | G03G 21/0094 |

FOREIGN PATENT DOCUMENTS

| | | | |
|---|---|---|---|
| JP | H07311531 | A | 11/1995 |
| JP | 2003036011 | A | 2/2003 |
| JP | 2007286246 | A | 11/2007 |
| JP | 2007292996 | A | 11/2007 |
| JP | 2009015229 | A | 1/2009 |

* cited by examiner

*Primary Examiner* — William J Royer
(74) *Attorney, Agent, or Firm* — Buchanan Ingersoll & Rooney PC

(57) ABSTRACT

An image forming apparatus includes a latent image carrier whose rotational speed changes depending on a printing speed of an image onto a sheet, an applicator that applies a lubricant to a surface of the latent image carrier, and a hardware processor that causes a surface of the applicator to move such that a difference between a first moving speed and a second moving speed is within a certain range, the first moving speed being a speed at which the surface of the latent image carrier moves, the second moving speed being a speed at which the surface of the applicator moves.

17 Claims, 10 Drawing Sheets

FIG. 6

101

| PROCESS SPEED | PHOTORECEPTOR SURFACE MOVING SPEED | INTERMEDIATE TRANSFER BELT ROTATION SPEED | FIXING ROLLER ROTATION SPEED | ··· | |
|---|---|---|---|---|---|
| HIGH | v11 | v21 | v31 | ··· | 6A1, 6A |
| STANDARD | v12 | v22 | v32 | ··· | 6A2, 6A |
| LOW | v13 | v23 | v33 | ··· | 6A3, 6A |

FIG. 7

102

| PHOTORECEPTOR SURFACE MOVING SPEED | BRUSH SURFACE MOVING SPEED | |
|---|---|---|
| v11 | v91 | 6B1, 6B |
| v12 | v92 | 6B2, 6B |
| v13 | v93 | 6B3, 6B |

FIG. 10

211

| SOLID LUBRICANT WEIGHT | PRESSING FORCE |
|---|---|
| w0 | p0 |
| w1 | p0 |
| w2 | p0 |
| w3 | p1 |
| w4 | p1 |
| w5 | p1 |
| w6 | p2 |
| w7 | p2 |
| w8 | p2 |
| ⋮ | ⋮ |

IMAGE FORMING APPARATUS, LUBRICANT APPLICATION METHOD, AND COMPUTER PROGRAM

The entire disclosure of Japanese patent Application No. 2018-199732, filed on Oct. 24, 2018, is incorporated herein by reference in its entirety.

BACKGROUND

Technological Field

The present invention relates to a technique for applying a lubricant to a photoreceptor drum of an image forming apparatus.

Description of the Related art

Image forming apparatuses having various functions, such as copying, scanning, faxing, and boxing, are widely used. Such image forming apparatuses may also be referred to as "multi-function peripherals (MFP)".

It has been performed that a lubricant is applied to a photoreceptor drum of an image forming apparatus to protect, from wear, members such as the photoreceptor drum itself and an intermediate transfer belt to be in contact with the photoreceptor drum. JP 2009-15229 A, JP 2007-292996 A, JP 2003-36011 A, JP H7-311531 A, and JP 2007-286246 A each disclose an invention for applying a lubricant to a photoreceptor drum.

An image forming apparatus described in JP 2009-15229 A includes: a lubricant applicator including a rotating member that scrapes and applies a solid lubricant to a surface of an image carrier; a storage that stores at least image forming information that is a total rotation time of the image carrier or a total rotation time of the rotating member; and a controller enabled to change a rotational speed of the rotating member during image formation and variably control the rotational speed of the rotating member on the basis of the information stored in the storage.

An image forming apparatus described in JP 2007-292996 A includes: an image carrier; a lubricant applicator that is a rotating body for applying a lubricant to the image carrier; and a charger that forms a latent image on a surface of the image carrier. In a case where the image carrier linear speed is variable and the image carrier linear speed is high, the linear speed of the rotating body (the lubricant applicator) is reduced.

An image forming apparatus described in JP 2003-36011 A includes a cleaning device that removes toner remaining on a photoreceptor drum after an image is formed by transferring a toner image formed on the photoreceptor drum enabled to rotate in at least two or more circumferential speeds of a first circumferential speed and a second circumferential speed higher than the first circumferential speed. When the photoreceptor drum rotates at a first circumferential speed VA in image formation, a cleaning brush that applies a lubricant is rotated at a first circumferential speed VB, and when a photoreceptor drum rotates at a second circumferential speed VA', the cleaning brush is rotated at a second circumferential speed VB'. At this time, there is a relationship of $VA<VA'$, $(VB/VA)>(VB'/VA')$.

An electrophotographic recording apparatus described in JP H7-311531 A includes: a lubricant applicator that applies a lubricant on an image carrier such as a transfer belt; a detector that detects an amount of the lubricant on the image carrier; and a controller that controls the lubricant applicator on the basis of a detection result of the detector. Then, when the lubricant is applied to the image carrier, the controller controls the lubricant applicator so that application operation is repeated until the detection result of the detector reaches a reference value of the amount of the lubricant on the image carrier.

A lubricant applicator included in an image forming apparatus described in JP 2007-286246 A includes a lubricant molded body and a brush-like roller. The brush-like roller rubs and scrapes the lubricant molded body while rotating, and applies the lubricant to a surface of an image carrier, and an amount of toner input to a cleaner is adjusted, and lubricant application is controlled depending on each image carrier linear speed.

Maintaining an amount of application of a lubricant to a photoreceptor drum, in other words, an amount of consumption of the lubricant in an appropriate amount is necessary to appropriately protect the photoreceptor drum and the like.

However, when a speed at which an image forming apparatus prints an image on a sheet (hereinafter referred to as "process speed") is changed, the amount of consumption of the lubricant may change from the appropriate amount.

When the amount of consumption of the lubricant changes to be greater than the appropriate amount, the lubricant may be exhausted earlier than planned, and there is a case where the photoreceptor drum and the like are not appropriately protected. On the other hand, when the amount of consumption of the lubricant changes to be less than the appropriate amount, the lubricant cannot be applied to a surface of the photoreceptor drum as much as necessary, and there is a case where the photoreceptor drum and the like are not appropriately protected.

SUMMARY

In view of such problems, it is an object of the present invention to ensure that the consumption of the lubricant can be maintained at the appropriate amount more reliably than before even in a case where the process speed is changed.

To achieve the abovementioned object, according to an aspect of the present invention, an image forming apparatus reflecting one aspect of the present invention comprises a latent image carrier whose rotational speed changes depending on a printing speed of an image onto a sheet, an applicator that applies a lubricant to a surface of the latent image carrier, and a hardware processor that causes a surface of the applicator to move such that a difference between a first moving speed and a second moving speed is within a certain range, the first moving speed being a speed at which the surface of the latent image carrier moves, the second moving speed being a speed at which the surface of the applicator moves.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 6 is a diagram illustrating an example of process speed data;

FIG. 7 is a diagram illustrating an example of brush speed data;

FIG. 10 is a diagram illustrating an example of pressing force data; and

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
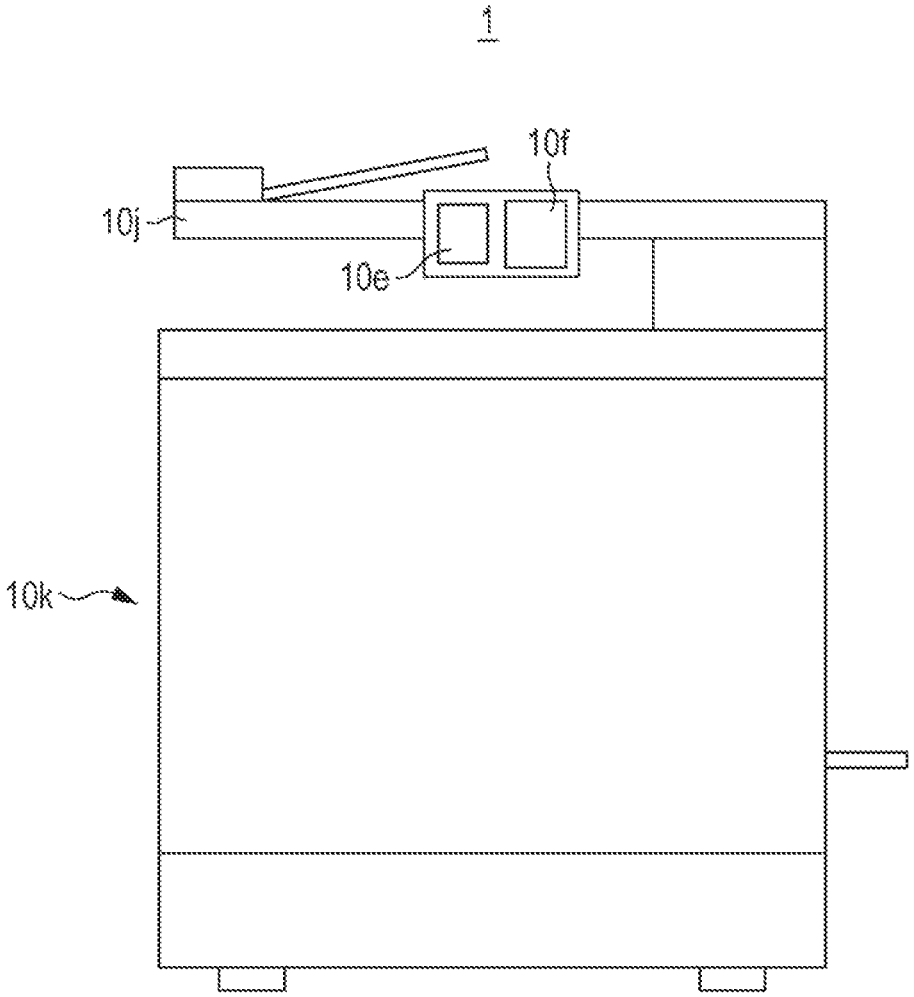
FIG. 1 is a diagram illustrating an example of appearance of an image forming apparatus.
Figure 2:
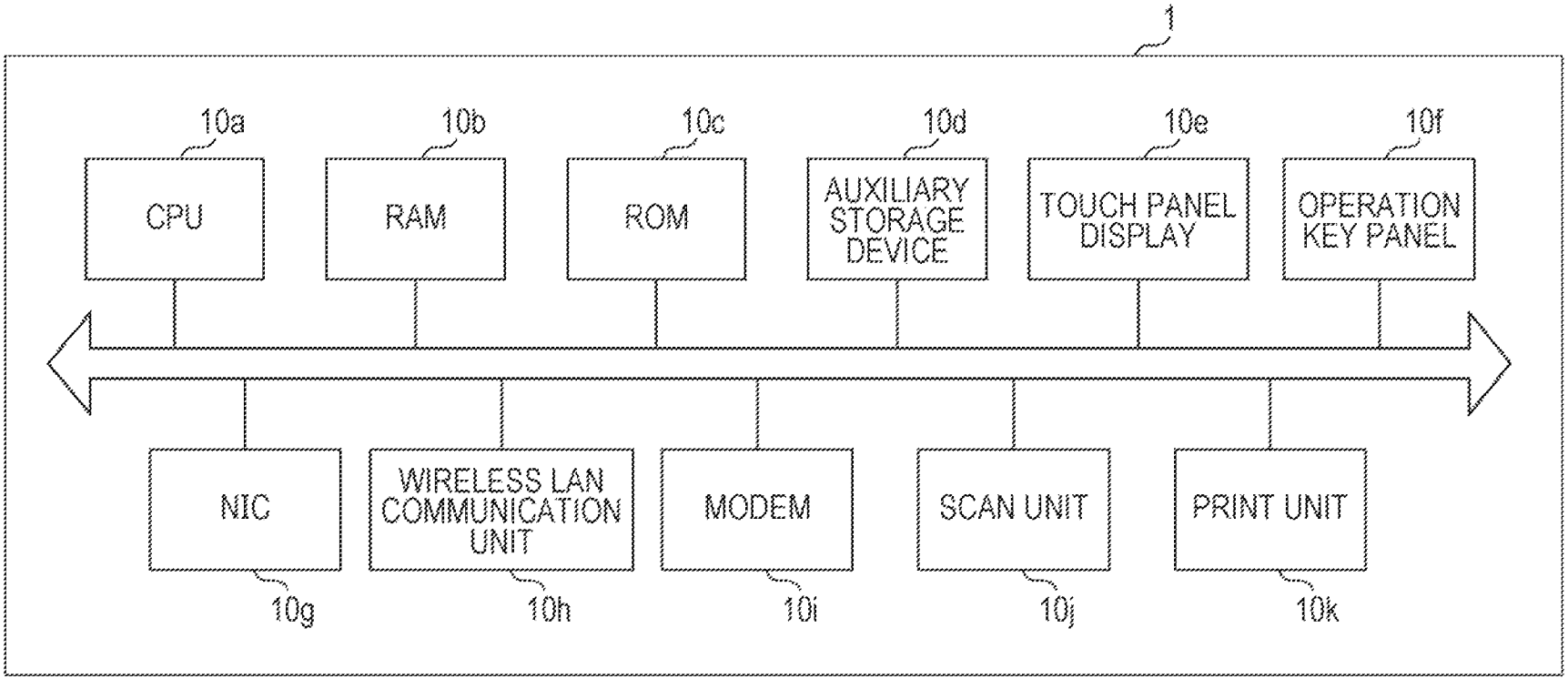
FIG. 2 is a diagram illustrating an example of a hardware configuration of the image forming apparatus.
Figure 3:
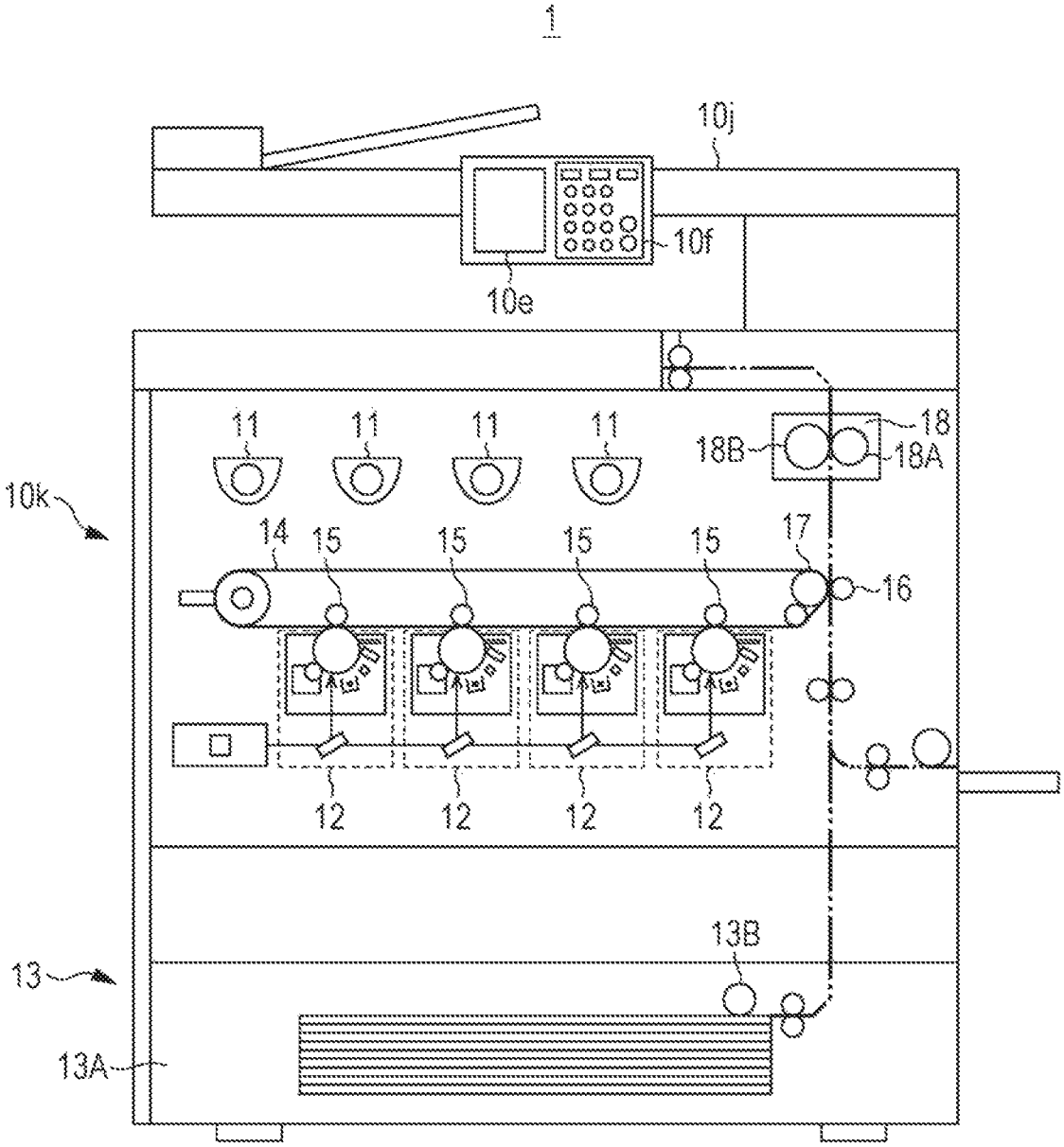
FIG. 3 is a diagram schematically illustrating an example of a configuration of a print unit.
Figure 4:
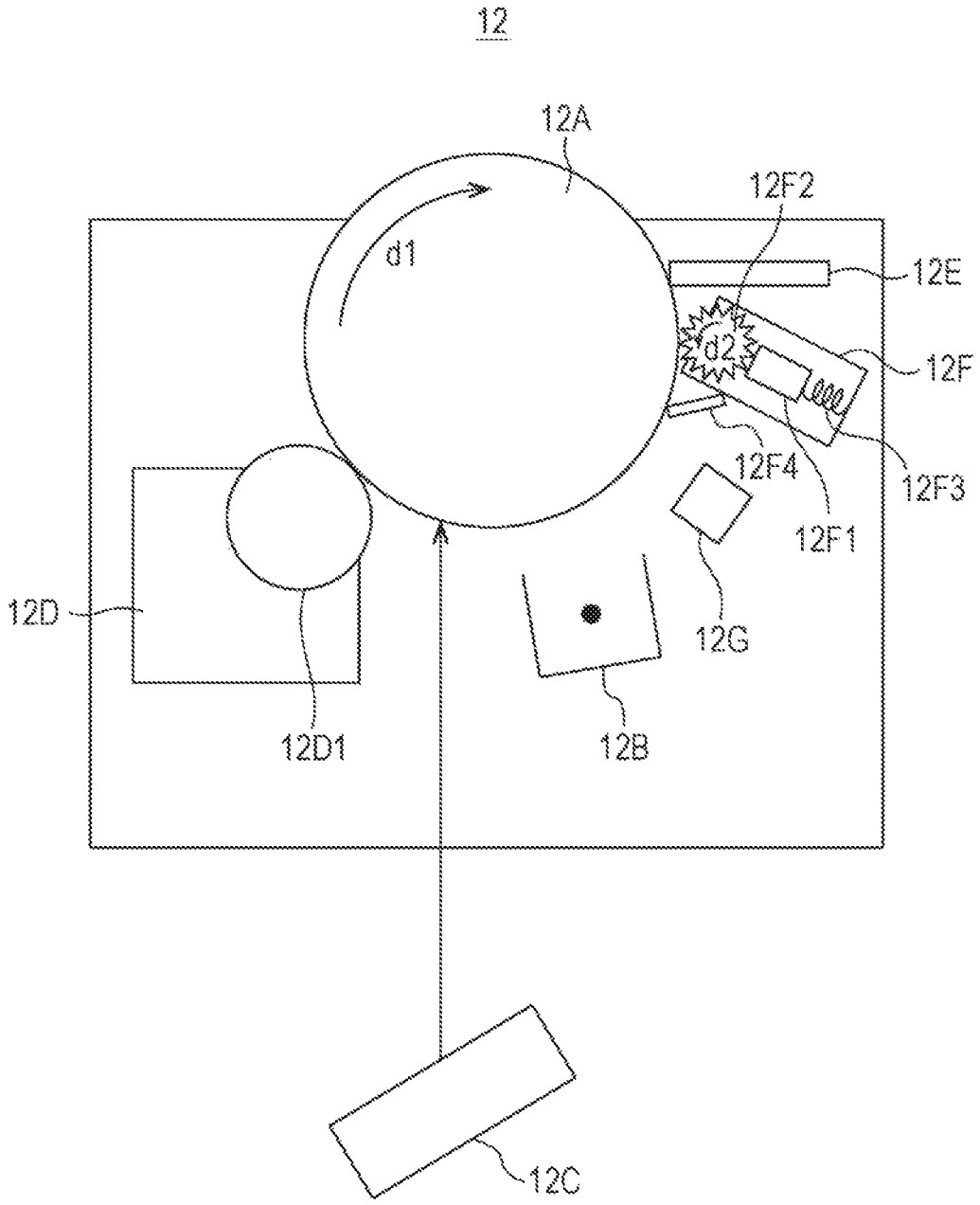
FIG. 4 is a diagram schematically illustrating an example of a configuration of an image forming unit.
Figure 5:
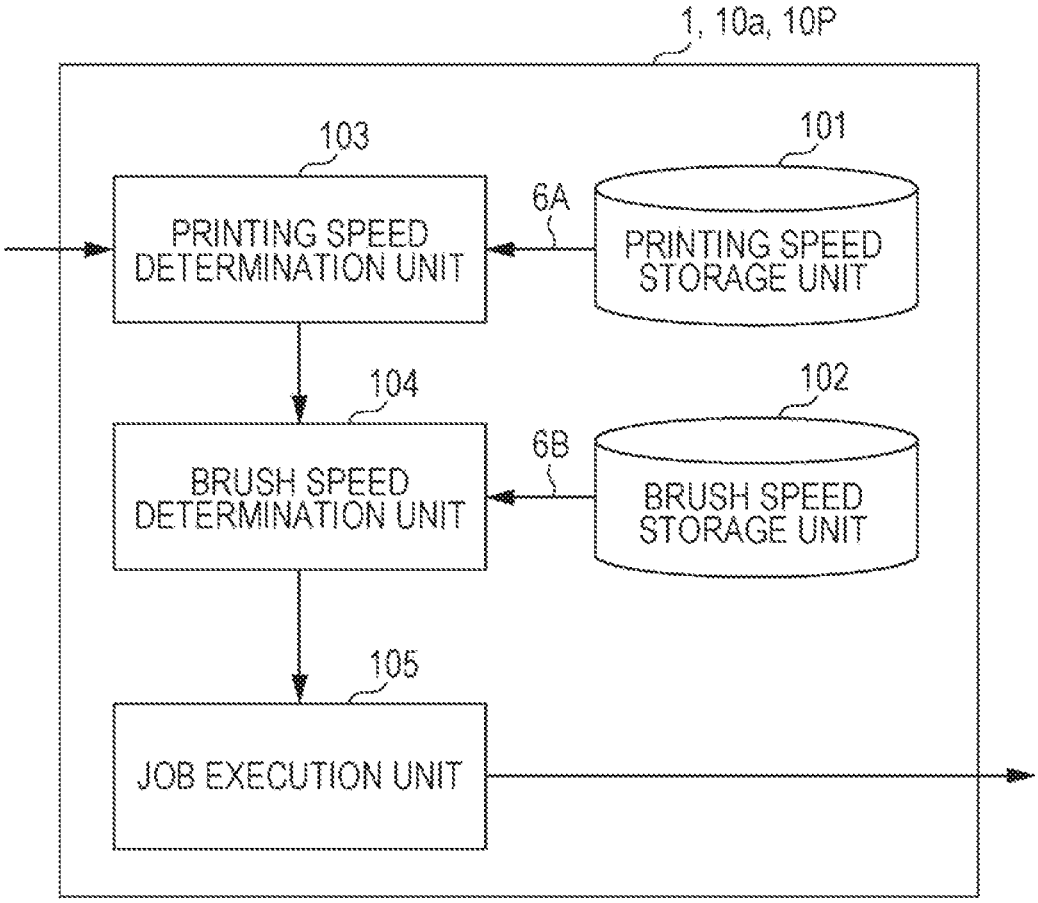
FIG. 5 is a diagram illustrating an example of a functional configuration of the image forming apparatus.

FIG. 1 is a diagram illustrating an example of appearance of an image forming apparatus 1. FIG. 2 is a diagram illustrating an example of a hardware configuration of the image forming apparatus 1. FIG. 3 is a diagram schematically illustrating an example of a configuration of a print unit 10*k*. FIG. 4 is a diagram schematically illustrating an example of a configuration of an image forming unit 12. FIG. 5 is a diagram illustrating an example of a functional configuration of the image forming apparatus 1.

The image forming apparatus 1 illustrated in FIG. 1 is an apparatus in which functions are integrated, such as copy, PC print, fax, scanner, and box. Generally, the image forming apparatus 1 may be referred to as a "multifunction machine" or "multi-function peripheral (MFP)".

The PC print function is a function of printing an image on a sheet on the basis of image data received from a terminal device in the same local area network (LAN) as that of the image forming apparatus 1. The PC print function may be referred to as "network printing" or "network print."

A cloud printing function is a function of receiving image data from an external terminal device via a server on the Internet and printing the image on a sheet.

The box function is a function for each user to store and manage image data and the like with one's own storage area, in which the storage area referred to as a "box" or a "personal box" for each user is provided. The box can also be provided for each group and shared by members of the group. The box corresponds to a "folder" or a "directory" in a personal computer.

The image forming apparatus 1 includes a central processing unit (CPU) 10*a*, random access memory (RAM) 10*b*, read only memory (ROM) 10*c*, an auxiliary storage device 10*d*, a touch panel display 10*e*, an operation key panel 10*f*, a network interface card (NIC) 10*g*, a wireless LAN communication unit 10*h*, a modem 10*i*, a scan unit 10*j*, the print unit 10*k*, and the like, as illustrated in FIG. 2.

The touch panel display 10*e* displays a screen indicating a message to the user, a screen for the user to input a command or information, and a screen indicating a result of processing executed by the CPU 10*a*. In addition, the touch panel display 10*e* transmits a signal indicating a position touched, to the CPU 10*a*.

The operation key panel 10*f* is a so-called hardware keyboard, and includes a numeric keypad, a start key, a stop key, and a function key.

The NIC 10*g* communicates with a terminal device or the like, using a protocol such as transmission control protocol/internet protocol (TCP/IP).

The wireless LAN communication unit 10*h* communicates with another device on the basis of a wireless LAN standard, in other words, the standard of Institute of Electrical and Electronics Engineers (IEEE) 802.11.

The modem 10*i* exchanges image data with a facsimile terminal, using a protocol such as G3.

The scan unit 10*j* reads an image drawn on a sheet set on a platen glass to generate image data.

The print unit 10*k* prints on a sheet the image read by the scan unit 10*j*, and also an image indicated in image data received from a terminal device or the like by the NIC 10*g*, the wireless LAN communication unit 10*h*, or the modem 10*i*.

The print unit 10*k* is a tandem system and electrophotographic system color printing engine. As illustrated in FIG. 3, the image forming apparatus 1 includes a toner bottle 11, the image forming unit 12, a sheet feeding unit 13, an intermediate transfer belt 14, a primary transfer roller 15, a secondary transfer roller 16, a backup roller 17, a fixing unit 18, and the like.

One toner bottle 11 and one image forming unit 12 are provided for each color of cyan, magenta, yellow, and black. Hereinafter, the toner bottle 11 and the image forming unit 12 of cyan will be described as an example.

The toner bottle 11 stores toner of cyan for replenishment. The toner is, for example, one in which a coloring agent and an external additive such as a charge control agent are contained in a binder resin. Note that, the toner desirably has a particle size of about 3 to 15 μm (micrometers). In addition, the toner bottle 11 contains a carrier for charging the toner. A particle size of the carrier is desirably about 15 to 100 μm.

As illustrated in FIG. 4, the image forming unit 12 includes a photoreceptor drum 12A, a charging device 12B, an exposure device 12C, a developing device 12D, a cleaning blade 12E, a lubricant application device 12F, an eraser 12G and the like.

The photoreceptor drum 12A is a photoreceptor drum for cyan. The photoreceptor drum 12A is, for example, one in which a photosensitive layer including a resin such as polycarbonate or silicone containing an organic photoconductor is formed on an outer circumferential surface of a drum-shaped metallic base. The photoreceptor drum 12A rotates in a direction of dl on the basis of a signal from the CPU 10*a*.

The charging device 12B uniformly charges a surface of the photoreceptor drum 12A to a negative polarity by applying a DC bias or an AC bias in which a DC voltage is superimposed on an AC voltage by using a corona charger.

The exposure device 12C forms an electrostatic latent image on the photoreceptor drum 12A by performing exposure depending on an image of image data on the basis of a signal from the CPU 10*a*.

The developing device 12D includes a developing sleeve 12D1. For example, a DC developing bias of the same polarity as that of the charging device 12B, or a developing bias in which a DC voltage of the same polarity as that of the charging device 12B is superimposed on an AC voltage, is applied to the developing sleeve 12D1, whereby inversion development (in other words, formation of a toner image) is performed that causes toner of cyan to adhere to the electrostatic latent image.

The cleaning blade 12E removes toner and the like remaining on the photoreceptor drum 12A. The cleaning blade 12E desirably has impact resilience of 30 to 70% at a temperature of 25 degrees. In addition, a desirable Japanese Industrial Standards (JIS)-A hardness is 60 to 80%.

The lubricant application device 12F protects the photoreceptor drum 12A and members in contact with the photoreceptor drum 12A from wear and the like by applying a lubricant to the photoreceptor drum 12A. The lubricant application device 12F includes a solid lubricant 12F1, a brush 12F2, a spring 12F3, a leveling blade 12F4, and the like.

The solid lubricant 12F1 has a length in the longitudinal direction (in other words, the depth direction of the main body of the image forming apparatus 1) of substantially the same as the length in the longitudinal direction of the photoreceptor drum 12A, and has a rod shape. The solid lubricant 12F1 includes fatty acid metal salt. Examples of the fatty acid metal salt include zinc stearate, magnesium stearate, aluminum stearate, iron stearate, and the like, and in particular, zinc stearate is desirable. Examples of the fatty acid of the fatty acid metal salt include chain hydrocarbon such as myristic acid, palmitic acid, stearic acid, or oleic acid, and in particular, stearic acid is desirable. In addition, examples of the metal include lithium, magnesium, calcium, zinc, cadmium, aluminum, cerium, titanium, iron, and the like.

Note that, silicone oil, fluorine resin, or the like may be used instead of the fatty acid metal salt. Alternatively, these may be mixed and used.

The brush 12F2 scrapes the lubricant from the solid lubricant 12F1 and applies the lubricant to the photoreceptor drum 12A. The brush 12F2 has, for example, a cylindrical shape, and is uniformly flocked on the surface. The length in the longitudinal direction of the brush 12F2 is substantially the same as the length in the longitudinal direction of the photoreceptor drum 12A, similarly to the solid lubricant 12F1. Note that, as long as it has a certain degree of flexibility, for example, a sponge can substitute for the brush.

The brush 12F2 rotates in a direction in which the photoreceptor drum 12A rotates, in other words, in a direction of d2 opposite to d1, on the basis of a signal from the CPU 10*a*.

The spring 12F3 brings the solid lubricant 12F1 into contact with the brush 12F2 by pushing the solid lubricant 12F1 in a direction toward the brush 12F2.

The leveling blade 12F4 levels the lubricant applied to the photoreceptor drum 12A. The leveling blade 12F4 desirably have impact resilience and JIS-A hardness similar to those of the cleaning blade 12E.

The eraser 12G discharges the surface of the photoreceptor drum 12A by exposure. The eraser 12G includes a light emitting diode (LED) or the like.

The toner bottle 11 and the image forming unit 12 of each of magenta, yellow, and black also have a role similar to that of the toner bottle 11 and the image forming unit 12 of cyan, and form the toner image of each of magenta, yellow, and black on the photoreceptor drum 12A.

The sheet feeding unit 13 includes one or more sheet feeding cassettes 13A, one or more pickup rollers 13B, and the like. The sheets stored in the sheet feeding cassette 13A are conveyed via a conveyance path indicated by a two-dot chain line in FIG. 3.

The intermediate transfer belt 14 is endless (in other words, annular), and rotates at a constant speed on the basis of a signal from the CPU 10*a*.

The primary transfer roller 15 is provided to face the photoreceptor drum 12A of a corresponding color for each of cyan, magenta, yellow, and black. The primary transfer roller 15 transfers the toner image on the photoreceptor drum 12A to the intermediate transfer belt 14 (in other words, primary transfer) by sandwiching the intermediate transfer belt 14 between the photoreceptor drum 12A and the primary transfer roller 15.

The secondary transfer roller 16 and the backup roller 17 secondarily transfer the toner image of the intermediate transfer belt 14 onto the sheet by sandwiching the sheet conveyed from the sheet feeding unit 13 and the intermediate transfer belt 14.

The fixing unit 18 includes a heating roller 18A, a pressure roller 18B, and the like.

The heating roller 18A is heated at a predetermined temperature to heat the sheet on which the toner image has been transferred. The pressure roller 18B fixes the toner image on the sheet by pressing the sheet toward the heating roller 18A. The heating roller 18A and the pressure roller 18B rotate on the basis of a signal from the CPU 10*a*.

The ROM 10*c* or the auxiliary storage device 10*d* stores an application for realizing the above-described function such as copying. In addition, a speed setting program 10P is stored as one of programs related to printing.

The speed setting program 10P is a program for setting a speed at which the photoreceptor drum 12A, the brush 12F2, or the like operates. With the speed setting program 10P, a printing speed storage unit 101 to a job execution unit 105 of FIG. 5 are realized in the image forming apparatus 1. Details of the program will be described later.

Programs such as the speed setting program 10P and the like are loaded on the RAM 10*b* if necessary, and executed by the CPU 10*a*.

FIG. 6 is a diagram illustrating an example of process speed data 6A. FIG. 7 is a diagram illustrating an example of brush speed data 6B.

Hereinafter, with reference to FIGS. 6 and 7, operations will be described of the printing speed storage unit 101 to the job execution unit 105 of FIG. 5 in a case where the image forming apparatus 1 prints an image read by the scan unit 10*j* on a sheet, as an example.

As illustrated in FIG. 6, the printing speed storage unit 101 stores the process speed data 6A indicating a speed at which the surface of the photoreceptor drum 12A moves (hereinafter referred to as "photoreceptor surface moving speed") and a speed at which the intermediate transfer belt 14 rotates, for each speed at which the image forming apparatus 1 prints an image on a sheet (hereinafter referred to as "process speed").

As illustrated in FIG. 7, a brush speed storage unit 102 stores the brush speed data 6B indicating a speed at which the surface of the brush 12F2 moves (hereinafter referred to as "brush surface moving speed") for each photoreceptor surface moving speed.

A difference between the brush surface moving speed and the photoreceptor surface moving speed (hereinafter referred to as "facing position relative speed") is constant regardless of the process speed. That is, "v91−v11=v92−v12=v93−v13". The reason is as follows.

When the brush 12F2 applies the lubricant to the photoreceptor drum 12A, the toner, carrier, and the like that cannot be removed from the photoreceptor drum 12A by the cleaning blade 12E (hereinafter referred to as "residue") may adhere to the brush 12F2. When the brush 12F2 in a state in which the residue adheres scrapes the lubricant from the solid lubricant 12F1, the lubricant may be scraped more than an appropriate amount by an amount of the intervening residue.

The amount of residue adhering to the brush 12F2 tends to increase as the brush surface moving speed increases with respect to the photoreceptor surface moving speed, in other words, as the facing position relative speed increases.

The facing position relative speed is therefore made constant regardless of the process speed so that an amount of the lubricant scraped from the solid lubricant 12F1 is maintained at the appropriate amount.

Hereinafter, the amount of the solid lubricant 12F1 scraped, in other words, consumed, with respect to a moving distance per unit of the surface of the photoreceptor drum 12A is referred to as "unit distance consumption".

Note that, the magnitude of the standard (in other words, default) brush surface moving speed is approximately 1.5 times the standard photoreceptor surface moving speed v1. In addition, if the process speeds are the same as each other, in principle, the brush surface moving speed is faster than the photoreceptor surface moving speed.

Note that, it is sufficient that the magnitudes of the facing position relative speeds of the respective process speeds are close to each other to some extent. That is, it is sufficient that the magnitudes are within a certain range.

For example, a facing position relative speed (V91−V11) of a certain process speed is determined as a standard value. It is sufficient that the magnitudes of facing position relative speeds (V92 −v12), (v93−v13), . . . of other process speeds are within a range of 90% to 110% of the standard value.

The user sets a document on the scan unit 10*j* and sets a print job condition. For example, finish quality of a printed matter is set to "high quality" better than the standard finish, and color printing is set. Then, a print job instruction is given to the image forming apparatus 1. Then, the following processing is performed.

A printing speed determination unit 103 determines a process speed on the basis of the print job condition set by the user. On the basis of the process speed data 6A of the determined process speed, a photoreceptor surface moving speed, a speed at which the intermediate transfer belt 14 rotates, and the like in the current print job are determined. Hereinafter, the photoreceptor surface moving speed of the current print job determined by the printing speed determination unit 103 is referred to as "determined photoreceptor speed".

For example, if the number of prints is five or less, "high quality" is set as a print finish condition, and color printing is set, the printing speed determination unit 103 determines "low" as the process speed. Then, on the basis of process speed data 6A3 of which the process speed is "low", "v13" is determined as the photoreceptor surface moving speed of the current print job. Thus, "v13" becomes the determined photoreceptor speed. Note that, the speed at which the intermediate transfer belt 14 rotates, and the like of the current print job is also determined.

A brush speed determination unit 104 determines a brush surface moving speed in the current print job on the basis of the brush speed data 6B of the determined photoreceptor speed. Hereinafter, the brush surface moving speed of the current print job determined by the brush speed determination unit 104 is referred to as "determined brush speed".

For example, in a case where the determined photoreceptor speed is "v13", the brush speed determination unit 104 determines "v93" as the brush surface moving speed of the current print job on the basis of brush speed data 6B3. Thus, "v93" becomes the determined brush speed.

The job execution unit 105 performs control so that each member of the image forming apparatus 1 moves at the process speed. The photoreceptor drum 12A is controlled to move at the determined photoreceptor speed. The brush 12F2 is controlled to move at the determined brush speed.

Figure 8:
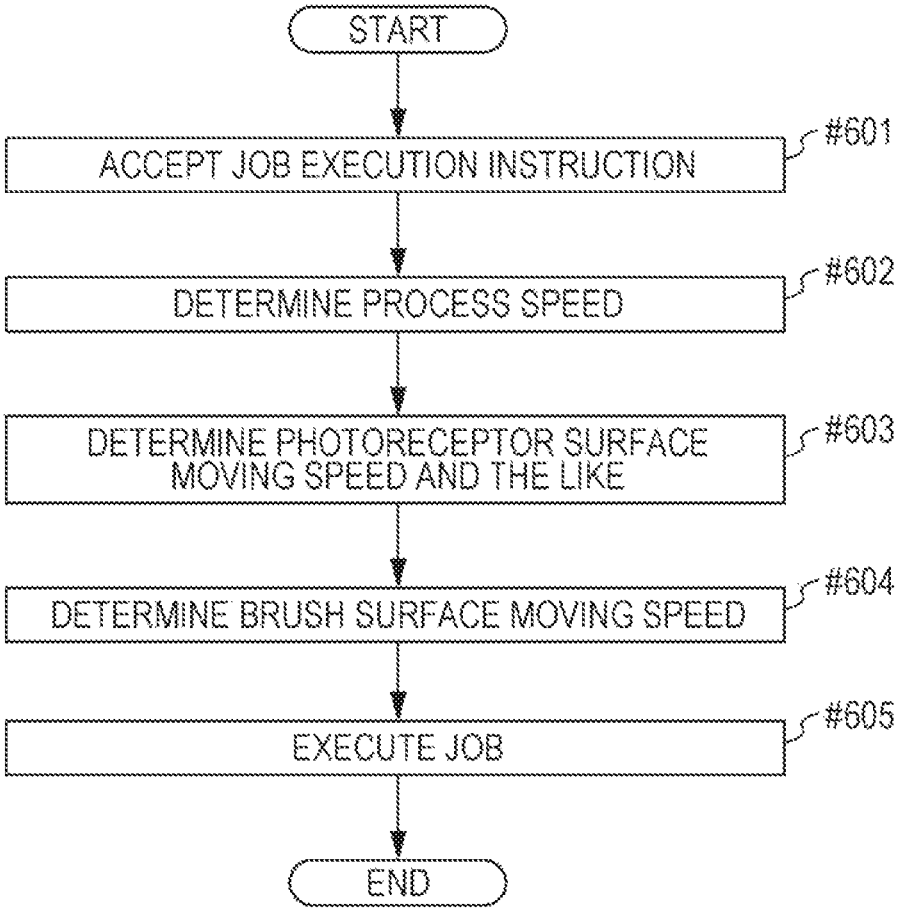
FIG. 8 is a flowchart illustrating an example of a flow of processing from when the image forming apparatus accepts a print job condition until the print job is executed.

FIG. 8 is a flowchart illustrating an example of a flow of processing from when the image forming apparatus 1 accepts a print job condition until the print job is executed.

Next, with reference to the flowchart of FIG. 8, the flow will be described of processing from when the image forming apparatus 1 accepts a print job condition until the print job is executed.

The image forming apparatus 1 executes the processing in a procedure illustrated in FIG. 8 on the basis of the speed setting program 10P.

When a job execution instruction is given after the print job condition is input from the user (#601 of FIG. 8), the image forming apparatus 1 determines a process speed on the basis of the input condition (#602), and on the basis of the process speed, determines a photoreceptor surface moving speed, and the like of the current print job (#603). On the basis of the determined photoreceptor speed, a brush surface moving speed is determined so that the facing position relative speed becomes constant (#604). The print job is executed while the photoreceptor drum 12A is moved at the determined photoreceptor speed and the brush 12F2 is moved at the determined brush speed (#605).

While a service is continued, the image forming apparatus 1 executes the above-described steps #601 to #605 each time a job execution instruction is given after the print job condition is input from the user.

According to an embodiment of the present invention, the consumption of the lubricant can be maintained at the appropriate amount more reliably than before even in the case where the process speed is changed.

Second Embodiment

Figure 9:
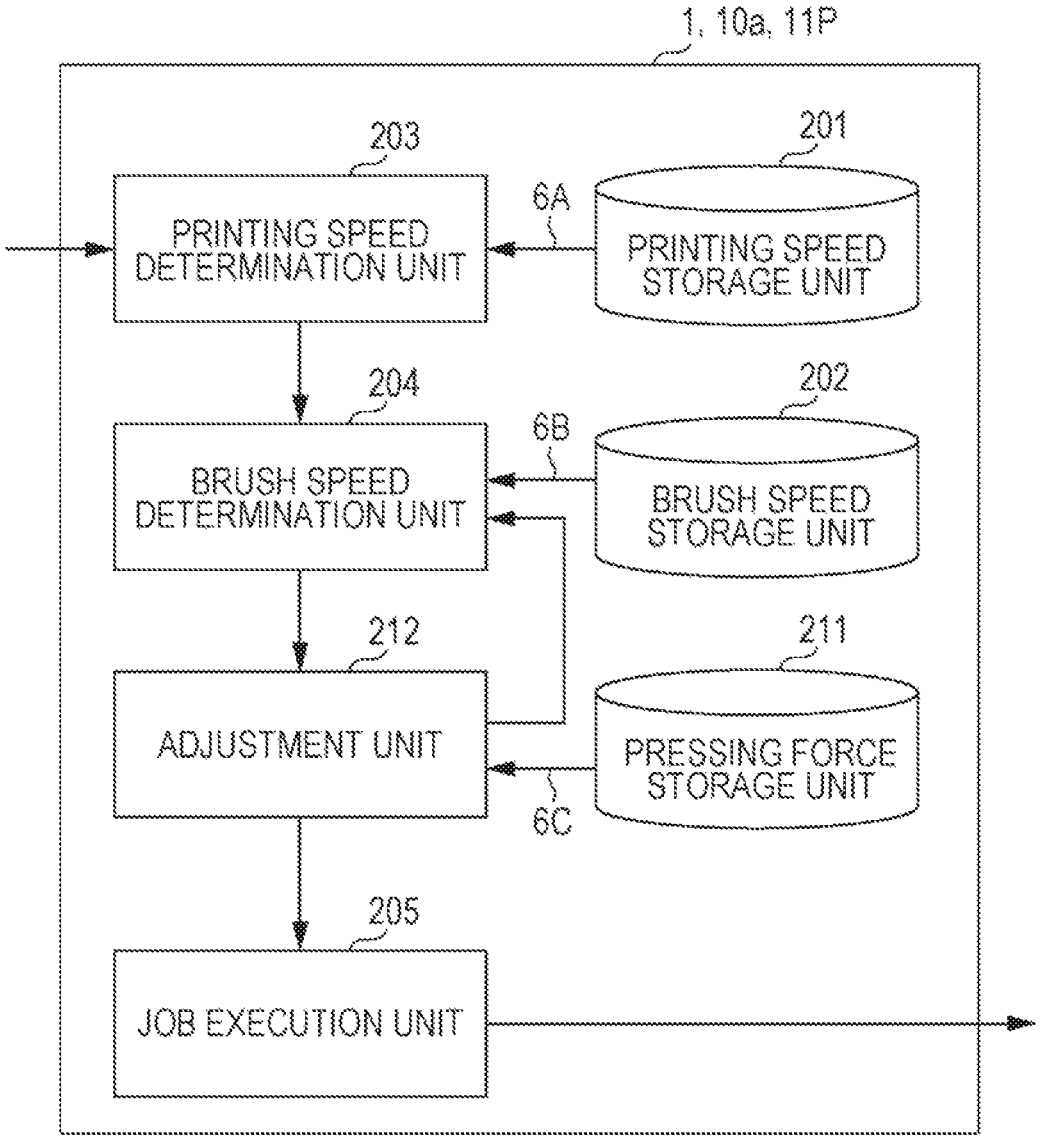
FIG. 9 is a diagram illustrating another example of the functional configuration of the image forming apparatus.

FIG. 9 is a diagram illustrating another example of the functional configuration of the image forming apparatus 1. FIG. 10 is a diagram illustrating an example of pressing force data 6C.

As the brush 12F2 scrapes the lubricant from the solid lubricant 12F1, the size of the solid lubricant 12F1 decreases and a distance between the solid lubricant 12F1 and the brush 12F2 increases. Then, the spring 12F3 extends in a direction toward the solid lubricant 12F1, and for that amount, force of the spring 12F3 pressing the solid lubricant 12F1 (hereinafter, referred to as "pressing force") becomes weak. As a result, it may become difficult for the brush 12F2 to scrape the lubricant from the solid lubricant 12F1, and unit distance consumption may be less than an appropriate amount.

Processing is therefore performed of finely adjusting the determined brush speed on the basis of the pressing force so that the unit distance consumption does not become less than the appropriate amount while the facing position relative speed is made constant (hereinafter referred to as "fine adjustment processing"). In the second embodiment, this processing will be described. Note that, description will be omitted of a point overlapping with the example of the above-described first embodiment.

The hardware configuration of the image forming apparatus 1 in the second embodiment is the same as that in the first embodiment (see FIGS. 1 to 4).

A second speed setting program 11P is stored in the ROM 10*c* or the auxiliary storage device 10*d* instead of the speed setting program 10P. In addition, a weight of the solid lubricant 12F1 in a default state, in other words, a weight in an unused state (hereinafter referred to as "default weight"), unit distance consumption of the appropriate amount (hereinafter referred to as "appropriate consumption"), and a product (hereinafter referred to as "reference value") of a pressing force when the unit distance consumption is the appropriate consumption and a facing position relative speed when the unit distance consumption is the appropriate consumption, are also stored. Note that, the reference value is calculated in advance by an experiment.

With the second speed setting program 11P, a printing speed storage unit 201 to an adjustment unit 212 of FIG. 9 are realized in the image forming apparatus 1. Hereinafter, with reference to FIG. 10, operations will be described of the printing speed storage unit 201 to the adjustment unit 212 in a case where the image forming apparatus 1 prints an image read by the scan unit 10*j* on a sheet, as an example.

The printing speed storage unit 201 stores the process speed data 6A similarly to the printing speed storage unit 101 described above. The brush speed storage unit 202 stores the brush speed data 6B similarly to the brush speed storage unit 102 described above.

As illustrated in FIG. 10, a pressing force storage unit 211 stores the pressing force data 6C indicating the pressing force for each weight of the solid lubricant 12F1. Weights of the solid lubricant 12F1 are "w0>w1>w2>w3, . . . ". Note that, the default weight is "w0". The pressing forces are "p0>p1>p2, . . . ".

When a print job instruction is given by the user, a printing speed determination unit 203 determines a photoreceptor surface moving speed, a speed at which the intermediate transfer belt 14 rotates, and the like of the current print job, on the basis of the process speed data 6A, similarly to the printing speed determination unit 103 described above.

Similarly to a brush speed determination unit 104 described above, the brush speed determination unit 204 determines a brush surface moving speed of the current print job on the basis of the brush speed data 6B.

The adjustment unit 212 performs the fine adjustment processing as follows each time a moving distance of the surface of the photoreceptor drum 12A after the lubricant application device 12F starts to be used (hereinafter, referred to as "photoreceptor total moving distance") becomes a predetermined distance.

The adjustment unit 212 calculates a product of the photoreceptor total moving distance and the appropriate consumption to obtain an amount of the solid lubricant 12F1 that has decreased after the solid lubricant 12F1 starts to be used (hereinafter referred to as "amount of decrease"). By calculating a difference between the default weight and the amount of decrease, a weight at the current point of time of the solid lubricant 12F1 (hereinafter, referred to as "current weight") is obtained. On the basis of the current weight and the pressing force data 6C of the pressing force storage unit 211, a pressing force at the current point of time (hereinafter referred to as "current pressing force") is identified.

The adjustment unit 212 finely adjusts the determined brush speed so that a product of the current pressing force and a difference between the determined brush speed after being finely adjusted and the determined photoreceptor speed becomes equal to the reference value.

That is, if the reference value is "S0", the current pressing force is "Pn", the determined brush speed is "v9n", and the determined photoreceptor speed is "v1n", α is calculated that satisfies the following formula (1). Then, the determined brush speed is finely adjusted by increasing the determined brush speed by α.

$$S0=Pn\times((v9n+\alpha)-v1n) \quad (1)$$

For example, if the photoreceptor total moving distance is "md" that is one of the predetermined distances, and the determined photoreceptor speed at this point of time is "v12" and the determined brush speed is "v92", the adjustment unit 212 performs the fine adjustment processing as follows.

The adjustment unit 212 calculates the amount of decrease by "md×appropriate consumption". The current weight is calculated by "w0−amount of decrease". Here, it is assumed that the current weight is "w4". On the basis of the pressing force data 6C, it is identified that the pressing force at the current point of time is pl. Calculation is performed of "α" that satisfies "S0 =p1 ×((v92+α)−v12)". Then, the determined brush speed is finely adjusted by adding "α" to the determined brush speed (in other words, "v92").

When the fine adjustment processing is performed during execution of the current print job, the brush speed determination unit 204 re-determines, as the determined brush speed, the determined brush speed after being finely adjusted.

Note that, the determined brush speed after being finely adjusted is stored in the auxiliary storage device 10*d* or the like. When a new print job is executed, if the brush surface moving speed of the brush speed data 6B of the determined photoreceptor speed corresponds to the determined brush speed after being finely adjusted stored in the auxiliary storage device 10*d* or the like (in other words, If the brush surface moving speed is the same as the default speed of the determined brush speed stored), the brush speed determination unit 204 determines the determined brush speed stored (in other words, the determined brush speed after being finely tuned) as a brush surface moving speed of the new print job.

For example, in a case where the determined brush speed is finely adjusted to "v92+α", when "v12" is determined as the determined photoreceptor speed in the new print job, the brush speed determination unit 204 determines "v92+α" as the brush surface moving speed of the new print job.

A job execution unit 205 controls each member of the image forming apparatus 1 similarly to the above description. Note that, when the fine adjustment processing is performed, the brush 12F2 is controlled to move at the determined brush speed after being finely adjusted.

Figure 11:
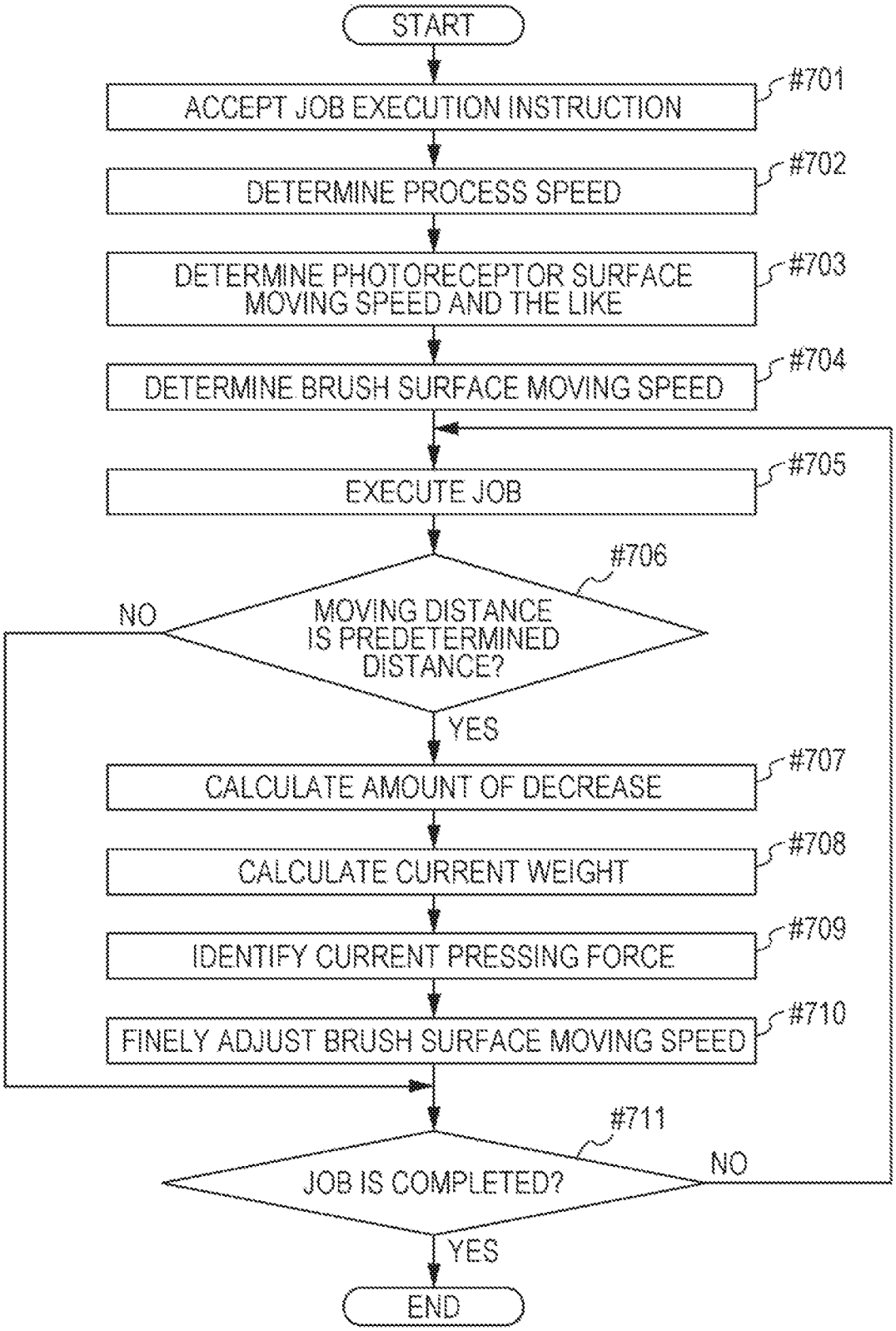
FIG. 11 is a flowchart illustrating another example of the flow of processing from when the image forming apparatus accepts a print job condition until the print job is executed.

FIG. 11 is a flowchart illustrating another example of the flow of processing from when the image forming apparatus 1 accepts a print job condition until the print job is executed.

Next, with reference to the flowchart of FIG. 11, the flow will be described of the entire processing in the image forming apparatus 1 of the second embodiment.

The image forming apparatus 1 executes the processing in a procedure illustrated in FIG. 11 on the basis of the second speed setting program 11P.

When a job execution instruction is given after the print job condition is input from the user (#701 of FIG. 11), the image forming apparatus 1, similarly to the above-described steps #601 to #605, determines a photoreceptor surface moving speed, a brush surface moving speed, and the like of the current print job, and execute the print job while moving the photoreceptor drum 12A at the determined photoreceptor speed and moving the brush 12F2 at the determined brush speed (#701 to #705).

When the moving distance of the surface of the photoreceptor drum 12A becomes a predetermined distance (#706: Yes), the image forming apparatus 1 calculates an amount of decrease (#707), calculates a current weight (#708), identify a current pressing force (#709), and finely adjusts the determined brush speed (#710). If the print job is not completed (No in #711), while the brush 12F2 is moved at the determined brush speed finely adjusted, the print job is continued (#705).

While a service is continued, the image forming apparatus 1 executes the above-described steps #701 to #711 each time a job execution instruction is given after the print job condition is input from the user.

Modifications

In the first and second embodiments described above, the brush speed determination unit 104 and the brush speed determination unit 204 determine the brush surface moving speed of the current print job by using the brush speed data 6B.

However, the brush surface moving speed of the current print job may be determined as follows, without using the brush speed data 6B.

The facing position relative speed is stored in advance in the auxiliary storage device 10*d* or the like. The brush speed determination unit 104 and the like may determine the brush surface moving speed of the current print job without using the brush speed data 6B, by determining a sum of the stored facing position relative speed (hereinafter referred to as "stored relative speed") and the determined photoreceptor speed, as the brush surface moving speed of the current print job.

For example, if the determined photoreceptor speed is "v11" and the stored relative speed is "r0", the brush speed determination unit 104 and the like determines "v11+r0" as the brush surface moving speed of the current print job.

In the first embodiment described above, the brush speed determination unit 104 may determine the brush surface moving speed of the current print job as follows, by using a ratio between the determined photoreceptor speed and the brush surface moving speed indicated in the brush speed data 6B of the determined photoreceptor speed (hereinafter referred to as "first circumferential speed ratio").

The brush speed determination unit 104 calculates a difference between the determined photoreceptor speed and the brush surface moving speed of the determined photoreceptor speed (in other words, the facing position relative speed), calculates a product of the difference and the first circumferential speed ratio, and calculates a sum of the product and the determined photoreceptor speed. The result is determined as the brush surface moving speed of the current print job.

That is, if the determined photoreceptor speed is "v1n" and the brush surface moving speed of the brush speed data 6B of which the determined photoreceptor speed is "v1n" is "v9n", a result of the following formula (2) is determined as the brush surface moving speed of the current print job.

$$v1n+((v9n-v1n)\times(v9n/v1n)) \quad (2)$$

Note that, the product of the facing position relative speed and the first circumferential speed ratio is constant regardless of the process speed. Alternatively, it is sufficient that the products of the facing position relative speed and the first circumferential speed ratio of the respective process speeds are close to each other to some extent (in other words, within a certain range).

Alternatively, when the brush speed data 6B is not used, the brush speed determination unit 104 may determine the brush surface moving speed of the current print job as follows, by using a ratio between the determined photoreceptor speed and a sum of the determined photoreceptor speed and the stored relative speed (hereinafter referred to as "second circumferential speed ratio").

The brush speed determination unit 104 calculates a product of the stored relative speed and the second circumferential speed ratio, and calculates a sum of the product and the determined photoreceptor speed. The result is determined as the brush surface moving speed of the current print job.

That is, if the determined photoreceptor speed is "y1n" and the stored relative speed is "r0", a result of the following formula (3) is determined as the brush surface moving speed of the current print job.

$$v1n+(r0\times((v1n+r0)/v1n)) \quad (3)$$

Note that, the product of the stored relative speed and the second circumferential speed ratio is constant regardless of the process speed. Alternatively, it is sufficient that the products of the stored relative speed and the second circumferential speed ratio of the respective process speeds are close to each other to some extent (in other words, within a certain range).

As described above, the brush surface moving speed of the current print job is determined by using the first circumferential speed ratio or the second circumferential speed ratio, in other words, by using a circumferential speed ratio between the brush 12F2 and the photoreceptor drum 12A, whereby the unit distance consumption can be more accurately maintained at the appropriate consumption.

In the second embodiment described above, the adjustment unit 212 obtains the current weight by calculating the difference between the default weight and the amount of decrease. However, the current weight may be obtained by other methods.

For example, when the fine adjustment processing is performed for the first time, a product is calculated of a photoreceptor total moving distance at a point of time of this (in other words, the first time) fine adjustment processing and the appropriate consumption, and a difference between the product and the default weight is calculated as a current weight at the point of time of the first fine adjustment processing.

After that, a difference is calculated between a photoreceptor total moving distance at a point of time of the nth fine adjustment processing and a photoreceptor total moving distance at a point of time of the (n−1)th fine adjustment processing, a product is calculated of the difference and the appropriate consumption, and a difference is calculated between the product and a current weight at the point of time of the (n−1)th fine adjustment processing, as a current weight at the point of time of the nth fine adjustment processing. Here, $n\geq 2$.

Alternatively, a relationship between a distance traveled by the surface of the brush 12F2 after the solid lubricant 12F1 starts to be used (hereinafter referred to as "brush total moving distance") and the weight of the solid lubricant 12F1 is experimentally obtained in advance, and on the basis of the relationship and the brush total moving distance at the point of time of the nth fine adjustment processing, the current weight at the time of the nth fine adjustment processing may be calculated.

In the second embodiment described above, the adjustment unit 212 performs the fine adjustment processing when the photoreceptor total moving distance becomes a predetermined distance. However, the fine adjustment processing may be performed at a timing other than when the photoreceptor total moving distance reaches the predetermined distance.

For example, the timing may be when power of the image forming apparatus 1 is turned on, when a power saving mode (in other words, a hibernation state) is released, or the like.

In the second embodiment described above, the adjustment unit 212 performs the fine adjustment processing on the basis of the current pressing force. However, the fine adjustment processing may be performed as follows.

The reference value is stored in the auxiliary storage device 10*d* similarly to the above description. The adjustment unit 212 identifies the current pressing force when the photoreceptor total moving distance becomes a predetermined distance, similarly to the above description.

The adjustment unit 212 finely adjusts the determined brush speed so that a product of a current pressing force, a difference between the determined brush speed after being finely adjusted and the determined photoreceptor speed, and a ratio between the determined brush speed after being finely adjusted and the determined photoreceptor speed, becomes equal to the reference value.

That is, if the reference value is "S0", the current pressing force is "Pn", the determined brush speed is "v9n", and the determined photoreceptor speed is "v1n", α is calculated that satisfies the following formula (4). Then, the determined brush speed is finely adjusted by increasing the determined brush speed by a.

$$S0=Pn\times((v9n+\alpha)-v1n)\times((v9n+\alpha)/v1n) \quad (4)$$

For example, under the same condition as the second embodiment described above (in other words, if the determined photoreceptor speed is "v12", the determined brush speed is "v92", and the current pressing force is "P1"), the adjustment unit 212 calculates a that satisfies "S0 =P1×((v92+a)−v12)×((v92+a)/v12))". The determined brush speed is finely adjusted by increasing "v92" by "α".

Alternatively, when the brush surface moving speed of the current print job is determined without using the brush speed data 6B, the adjustment unit 212 may perform the fine adjustment processing as follows.

The brush speed determination unit 204 determines a sum of the stored relative speed and the determined photoreceptor speed as the brush surface moving speed of the current print job. The result becomes the determined brush speed.

The adjustment unit 212 identifies the current pressing force when the photoreceptor total moving distance becomes a predetermined distance, similarly to the above description. The determined brush speed is finely adjusted so that a product of a current pressing force, a difference between the determined brush speed after being finely adjusted and the determined photoreceptor speed, and a ratio between the determined brush speed after being finely adjusted and the determined photoreceptor speed, becomes equal to the reference value.

That is, if the reference value is "S0", the current pressing force is "Pn", and the determined photoreceptor speed is "v1 n", v9x is calculated that satisfies the following formula (5). Then, the determined brush speed is finely adjusted by setting "v9n" that is the determined brush speed before being finely adjusted, to "v9x".

$$S0=Pn\times(v9x-v1n)\times(v9x/v1n) \quad (5)$$

In the first and second embodiments described above, when the solid lubricant 12F1 and the brush 12F2 are new, the brush 12F2 may scrape the lubricant more than usual by making the brush surface moving speed of the current print job larger than a value indicated in the brush speed data 6B, until the photoreceptor total moving distance exceeds a certain degree of distance. Alternatively, the brush 12F2 may scrape the lubricant more than usual by adding a value larger than the stored relative speed to the photoreceptor surface moving speed.

Since the surface side of the new solid lubricant 12F1 is harder than the inside, and since the shape of the new brush 12F2 has not conformed to the shape of the new solid lubricant 12F1, there is a case where the brush 12F2 cannot sufficiently scrape the lubricant from the solid lubricant 12F1. For that reason, for example, the brush surface moving speed of the current print job is made larger than the value indicated in the brush speed data 6B so that the brush 12F2 can sufficiently scrape the lubricant.

In the first and second embodiments described above, the adjustment unit 212 may further finely adjust the determined brush speed on the basis of information such as temperature and humidity around the image forming apparatus 1. For example, if the temperature is 30 degrees or more, the determined brush speed is finely adjusted to 0.9 times, and if the temperature is 10 degrees or less, the determined brush speed is finely adjusted to 1.1 times.

In the first and second embodiments described above, as a mechanism for rotating the brush 12F2, any mechanism of a plurality of mechanisms for driving other members of the image forming apparatus 1 (hereinafter referred to as "other drive mechanisms")) may be shared. The job execution unit 105 or the job execution unit 205 is only required to execute a print job by using the mechanism.

At this time, among the plurality of other drive mechanisms, it is desirable to use, as a mechanism of the brush 12F2, another drive mechanism capable of rotating the brush 12F2 at a speed closest to the brush surface moving speed of the brush speed data 6B of the determined photoreceptor speed, or closest to a speed obtained by adding the determined photoreceptor speed to the stored relative speed.

Alternatively, it is desirable to use, as the mechanism of the brush 12F2, other than another drive mechanism of which a facing relative speed when the process speed is low is minimized among the plurality of other driving mechanisms (hereinafter referred to as "minimum relative speed mechanism").

When the minimum relative speed mechanism is used as the mechanism of the brush 12F2, the unit distance consumption may be minimized when the process speed is low. In other words, an amount of the lubricant applied to the photoreceptor drum 12A may be minimized As a result, the lubricant applied to the photoreceptor drum 12A may be insufficient.

A mechanism other than the minimum relative speed mechanism is therefore used as the mechanism of the brush 12F2, whereby the amount of lubricant applied to the photoreceptor drum 12A is prevented from becoming insufficient when the process speed is low.

Further, it is desirable that the other drive mechanism used as the mechanism of the brush 12F2 is not only a mechanism other than the minimum relative speed mechanism, but also is a mechanism of which the facing relative speed when the process speed is low is less than a facing relative speed when the process speed is high.

This is to avoid that the unit distance consumption when the process speed is low is greater than or equal to the unit distance consumption when the process speed is high.

Moreover, the configuration of the entire or each part of the image forming apparatus 1, the contents of processing, the order of processing, the configuration of data such as the process speed data 6A, the brush speed data 6B, and the pressing force data 6C, and the like can be changed as appropriate in accordance with the spirit of the present invention.

Although embodiments of the present invention have been described and illustrated in detail, the disclosed embodiments are made for purposes of illustration and example only and not limitation. The scope of the present invention should be interpreted by terms of the appended claims

What is claimed is:

1. An image forming apparatus comprising:

a latent image carrier whose rotational speed changes depending on a printing speed of an image onto a sheet;

an applicator that applies a lubricant to a surface of the latent image carrier; and a hardware processor that causes a surface of the applicator to move such that a difference between a first moving speed and a second moving speed is within a certain range, the first moving speed being a speed at which the surface of the latent image carrier moves, the second moving speed being a speed at which the surface of the applicator moves.

2. The image forming apparatus according to claim 1, wherein the hardware processor causes the surface of the applicator to move such that the difference is within the certain range, after a distance traveled by the surface of the applicator after the lubricant and the applicator start to be used becomes a predetermined distance.

3. The image forming apparatus according to claim 1, further comprising a pressor that presses the lubricant against the applicator to enable the applicator to scrape the lubricant, wherein the hardware processor causes the surface of the applicator to move such that the second moving speed becomes faster as pressing force by which the pressor presses the lubricant against the applicator becomes smaller.

4. The image forming apparatus according to claim 1, wherein the hardware processor causes the surface of the applicator to move, further on a basis of temperature or humidity of a place where the image forming apparatus is installed.

5. The image forming apparatus according to claim 1, further comprising a driver that moves the surface of the applicator, and drives any one of a plurality of members of the image forming apparatus.

6. The image forming apparatus according to claim 1, further comprising a plurality of drivers that respectively drives a plurality of members of the image forming apparatus, wherein the hardware processor causes the surface of the applicator to move by a non-minimum driver among the plurality of drivers, the non-minimum driver being other than a minimum driver of which the difference when the printing speed becomes lower than a standard speed is minimized among the plurality of drivers.

7. The image forming apparatus according to claim 6, wherein the hardware processor causes the surface of the applicator to move by the non-minimum driver of which the difference when the printing speed becomes lower than the standard speed becomes less than the difference when the printing speed becomes higher than the standard speed.

8. An image forming apparatus comprising:

a latent image carrier whose rotational speed changes depending on a printing speed of an image onto a sheet;

an applicator that applies a lubricant to a surface of the latent image carrier; and a hardware processor that causes a surface of the applicator to move such that a product of a difference between a first moving speed and a second moving speed and a ratio between the first moving speed and the second moving speed is within a certain range, the first moving speed being a speed at which the surface of the latent image carrier moves, the second moving speed being a speed at which the surface of the applicator moves.

9. The image forming apparatus according to claim 8, wherein the hardware processor causes the surface of the applicator to move such that the product is within the certain range, after a distance traveled by the surface of the applicator after the lubricant and the applicator start to be used becomes a predetermined distance.

10. The image forming apparatus according to claim 8, further comprising a pressor that presses the lubricant against the applicator to enable the applicator to scrape the lubricant, wherein the hardware processor causes the surface of the applicator to move such that the second moving speed becomes faster as pressing force by which the pressor presses the lubricant against the applicator becomes smaller.

11. The image forming apparatus according to claim 8, wherein the hardware processor causes the surface of the applicator to move, further on a basis of temperature or humidity of a place where the image forming apparatus is installed.

12. The image forming apparatus according to claim 3, further comprising a driver that moves the surface of the applicator, and drives any one of a plurality of members of the image forming apparatus.

13. The image forming apparatus according to claim 3, further comprising a plurality of drivers that respectively drives a plurality of members of the image forming apparatus, wherein the hardware processor causes the surface of the applicator to move by a non-minimum driver among the plurality of drivers, the non-minimum driver being other than a minimum driver of which the difference when the printing speed becomes lower than a standard speed is minimized among the plurality of drivers.

14. A lubricant application method comprising:

applying a lubricant by an applicator to a surface of a latent image carrier whose rotational speed changes depending on a printing speed of an image onto a sheet; and causing a surface of the applicator to move such that a difference between a first moving speed and a second moving speed is within a certain range, the first moving speed being a speed at which the surface of the latent image carrier moves, the second moving speed being a speed at which the surface of the applicator moves.

15. A lubricant application method comprising:

applying a lubricant by an applicator to a surface of a latent image carrier whose rotational speed changes depending on a printing speed of an image onto a sheet; and causing a surface of the applicator to move such that a product of a difference between a first moving speed and a second moving speed and a ratio between the first moving speed and the second moving speed is within a certain range, the first moving speed being a speed at which the surface of the latent image carrier moves, the second moving speed being a speed at which the surface of the applicator moves.

16. A non-transitory recording medium storing a computer readable program for controlling an image forming apparatus including a latent image carrier whose rotational speed changes depending on a printing speed of an image onto a sheet, the program causing the image forming apparatus to execute:

processing of applying a lubricant to a surface of the latent image carrier by an applicator; and processing of causing a surface of the applicator to move such that a difference between a first moving speed and a second moving speed is within a certain range, the first moving speed being a speed at which the surface of the latent image carrier moves, the second moving speed being a speed at which the surface of the applicator moves.

17. A non-transitory recording medium storing a computer readable program for controlling an image forming apparatus including a latent image carrier whose rotational speed changes depending on a printing speed of an image onto a sheet, the program causing the image forming apparatus to execute:

processing of applying a lubricant to a surface of the latent image carrier by an applicator; and processing of causing a surface of the applicator to move such that a product of a difference between a first moving speed and a second moving speed and a ratio between the first moving speed and the second moving speed is within a certain range, the first moving speed being a speed at which the surface of the latent image carrier moves, the second moving speed being a speed at which the surface of the applicator moves.

* * * * *